US005644810A

United States Patent [19]

Kato

[11] Patent Number: 5,644,810

[45] Date of Patent: Jul. 8, 1997

[54] PILLOW FOR SUPINE AND SIDE-ORIENTATED SLEEPING POSITIONS

[76] Inventor: Katsuya Kato, #408 1000-4-2 Shinei-cho, Kusaka-shi, Saitama, Japan, 340

[21] Appl. No.: 731,776

[22] Filed: Oct. 18, 1996

[30] Foreign Application Priority Data

Dec. 5, 1995 [JP] Japan ..... 7-0144441

[51] Int. Cl.[6] ..... A47C 9/02

[52] U.S. Cl. ..... 5/645; 5/490

[58] Field of Search ..... 5/636, 640, 645, 5/490

[56] References Cited

U.S. PATENT DOCUMENTS

| | | | |
|---|---|---|---|
| 1,020,444 | 3/1912 | Platt | 5/645 |
| 1,206,775 | 11/1916 | Everts | 5/645 |
| 3,411,164 | 11/1968 | Sumergrade | 5/645 X |
| 3,521,310 | 7/1970 | Greenawalt | 5/636 |
| 4,513,462 | 4/1985 | Thomas | 5/636 X |
| 4,660,239 | 4/1987 | Thomas | 5/645 |
| 5,038,432 | 8/1991 | Rubillar et al. | 5/645 |
| 5,471,691 | 12/1995 | Ryndak | 5/630 X |

*Primary Examiner*—Michael F. Trette
*Attorney, Agent, or Firm*—Richard S. Ross, Esq.

[57] ABSTRACT

A pillow for supine and side-oriented sleeping positions comprises a pillow casing for a pillow having opposed horizontal side head end support units and a central head back support unit there between comprising vertically opposed neck-bones' support sections separated by an overall central head back rest section. The respective units and sections are segregated into attached, compartmentalized areas where the head back support unit is lower than the horizontal end support units, and the head back rest section is lower than the vertically opposed neck-bones' support sections. A first side head support unit is constructed at the end of horizontal end section of the pillow casing of the pillow. A second side head support unit is constructed at the opposed horizontal end section of the pillow casing. A head back support unit is placed between the first and second side head support units. These support units are constructed by those casings which include a first side head support unit casing, a second side head support unit casing and a head back support unit casing. These casings are made from cloth or other suitable materials and filled by core filling materials. The first side head support unit and second side head support unit are constructed at the same height while the head back support unit is constructed at a lower height than that of the first and second side head support units.

6 Claims, 2 Drawing Sheets

PILLOW FOR SUPINE AND SIDE-ORIENTATED SLEEPING POSITIONS

FIELD OF THE INVENTION

This invention relates to a pillow. More particularly, the present invention relates to a pillow for supine and side-orientated sleeping positions to allow stable and natural sleeping posture by means of support for a neck-bones' section in a face upwards position, stable rest for the back-head section, and support for side-head and neck-bones' sections.

BACKGROUND OF THE INVENTION

Human actions, such as sleeping postures and turning over in bed with pillows, are consistent according to human engineering and physiology. The desire for humans to form their bodies into natural and comfortable posture according to their body shape has led to the use of pillows. However, very little scientific research on the subject of pillows has been conducted. Generally speaking, most pillows are simply made out of a containment holder or bag in the form of a pillow filled with a variety of soft media.

Recent studies suggest the use of neck-bones' support pillows since supporting neck bones brings good physiological results in breathing and blood circulation. However, it is difficult for humans to obtain sound sleep by means of supporting neck bones alone when one sleeps in supine and side-orientated sleeping positions.

SUMMARY OF THE INVENTION

A pillow for supine and side-oriented sleeping positions comprises a pillow casing for a pillow having opposed horizontal side head end support units and a central head back support unit there between comprising vertically opposed neck-bones' support sections separated by an overall central head back rest section. The respective units and sections are segregated into attached, compartmentalized areas where the head back support unit is lower than the horizontal end support units, and the head back rest section is lower than the vertically opposed neck-bones' support sections. A first side head support unit is constructed at the end of horizontal end section of the pillow casing of the pillow. A second side head support unit is constructed at the opposed horizontal end section of the pillow casing. A head back support unit is placed between the first and second side head support units. These support units are constructed by those casings which include a first side head support unit casing, a second side head support unit casing and a head back support unit casing. These casings are made from cloth or other suitable materials and filled by core filling materials. The first side head support unit and second side head support unit are constructed at the same height while the head back support unit is constructed at a lower height than that of the first and second side head support units.

BRIEF DESCRIPTION OF THE DRAWINGS

The features embodying the present invention are illustrated in the accompanying drawing, forming a part of this application, in which.

DETAILED DESCRIPTION OF A PREFERRED EMBODIMENT

Figure 1:
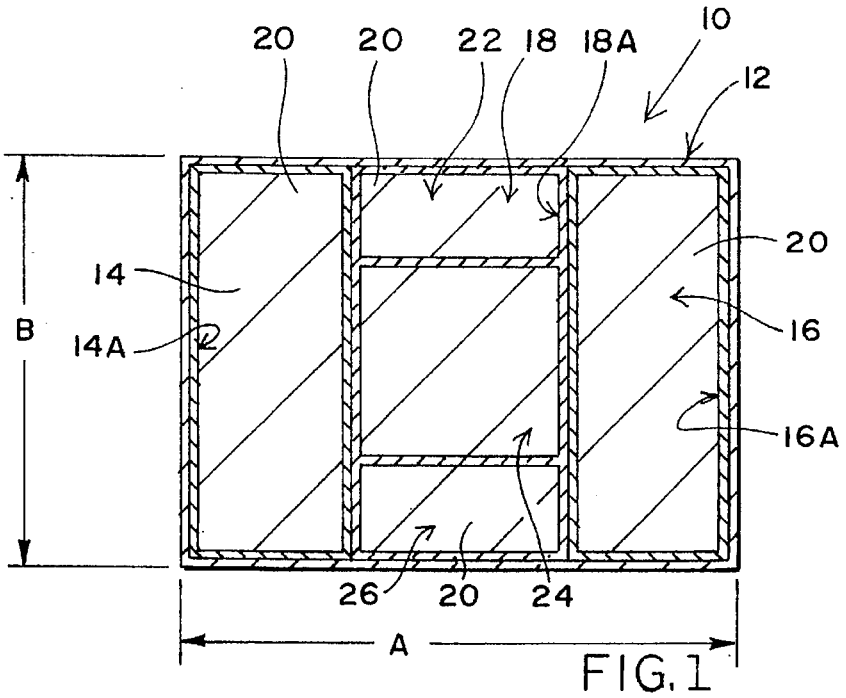
FIG. 1 is a top plan view of the present invention.

A detailed description of a preferred embodiment of the present invention is illustrated in FIGS. 1–4. As shown in FIG. 1, pillow casing 12 of the pillow for supine and side-orientated sleeping positions 10 is made from appropriate and conventional materials, such as cloth, in a bag shape. Pillow casing 12 has an open section (not shown), which has a fastener. Horizontal width A of pillow casing 12 is greater than its vertical depth B.

A first side head support unit 14 is built in at one vertical end section of pillow casing 12 while a second side head support unit 16 is built in at a second, opposed vertical end section of the pillow casing 12. A head back support unit 18 is mounted between the first side head support unit 14 and the second side head support unit 16. These support units which include the first side head support unit 14, the second side head support unit 16, and the head back support unit 18, are constructed by those casings which include, respectively, a first side head support unit casing 14A, a second side head support unit casing 16A, and a head back support unit casing 18A. These casings are filled by core filling materials 20 well known in the art including, but not limited to, plastic string, plastic balls, straw, feathers, sponge, ceiba, silk, or other cotton-like materials. The first side head support unit casing 14A, second side head support unit casing 16A, and head back support unit casing 18A have an opening (not shown) to which a fastener is attached so that the core filling materials 20 can be introduced therein.

Figure 4:
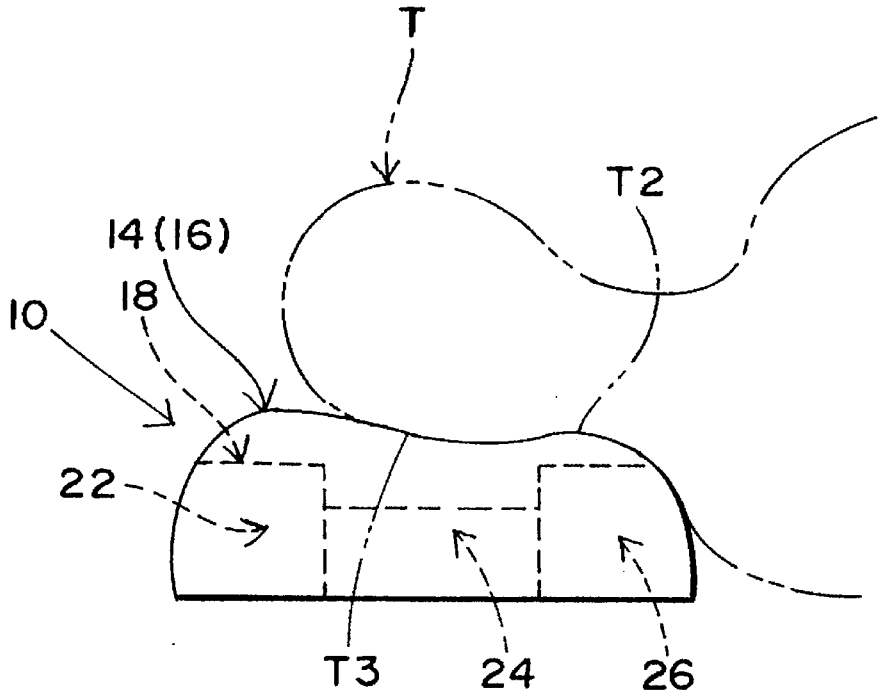
FIG. 4 depicts a side view of the present invention showing the physical positioning of a human's head, neck and shoulder regions in a side-orientated sleeping position.

As shown in FIG. 4, the height of both first side head support unit 14 and second side head support unit 16 are the same, while the height of the head back support unit 18 is lower than the first side head support unit 14 and second side head support unit 16. Under normal circumstances, head posture relative to the neck of a user will be kept natural if the height of the head back support unit 18 is constructed about one (1) centimeter lower than the first side head support unit 14 and the second side head support unit 16.

Figure 2:
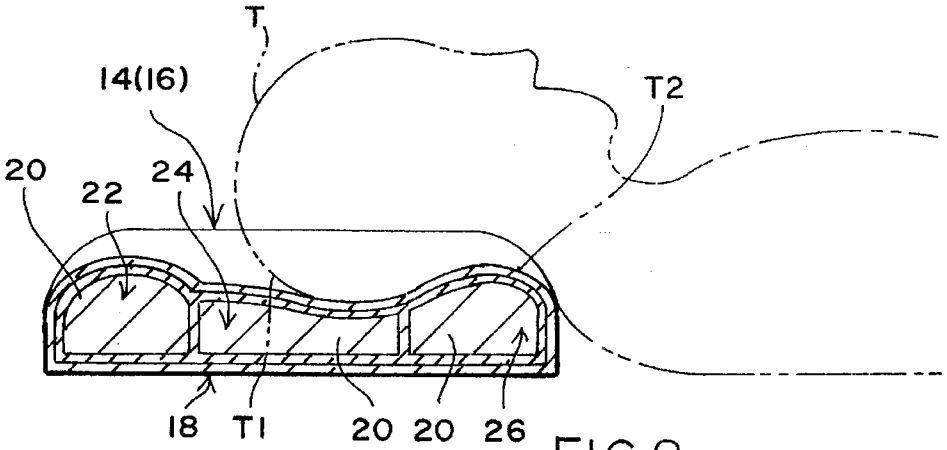
FIG. 2 is a cross section view of the present invention taken parallel to Line B.
Figure 3:
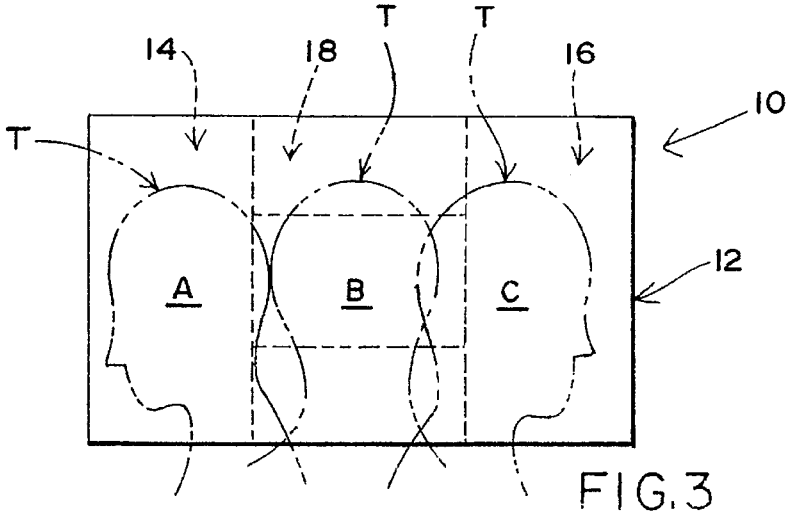
FIG. 3 is a diagrammatic, plan view of the present invention showing respective supine and side-orientated positions of a human head.

As shown in FIG. 1, the inside of the head back support unit 18 is divided into three areas, vertically from one end to the other of the pillow 10: a first neck-bones' support section 22, a head back rest section 24 and a second neck-bones' support section 26. As seen in FIG. 2, the height of the first neck-bones' support section 22 and the second neck-bones' support section 26 is identical. The height of neck-bones' support sections 22 and 26 will be determined by the depth of the neck-bones' curve of the user, but in general, the preferred depth for men is approximately 4.1 cm and approximately 3.2 cm for women. Also, the height of head back rest section 24 is constructed lower than the first neck-bones' support section 22 and the second neck-bones' support section 26. The preferred height for the head back rest section 24 is one in which there is approximately a five (5) degree tilt when a user's head is rested thereon the pillow 10. Further, since there are openings available with the first side head support unit 14, the second side head support unit 16 and the head back support unit 18, the user can easily regulate the optimum height by increasing or decreasing the amount of core filling materials 20.

As may be seen in FIG. 2, when a head T is interfaced with the head back support unit 18 (position B shown in FIG. 3), both the head back T1 and the neck bones T2 are support by the second neck-bones' support section 26. By these means, head T is secured and the position for sound sleep is maintained. When the user turns over to a side orientated position as represented by positions A and C in FIGS. 3 and 4, head side T3 and neck bones T2 are supported by the first side head support trait 14 or the second side head support unit 16. Therefore, even when the user turns over to the side, head T will be held securely and the position for sound sleep is maintained.

Figure 5:
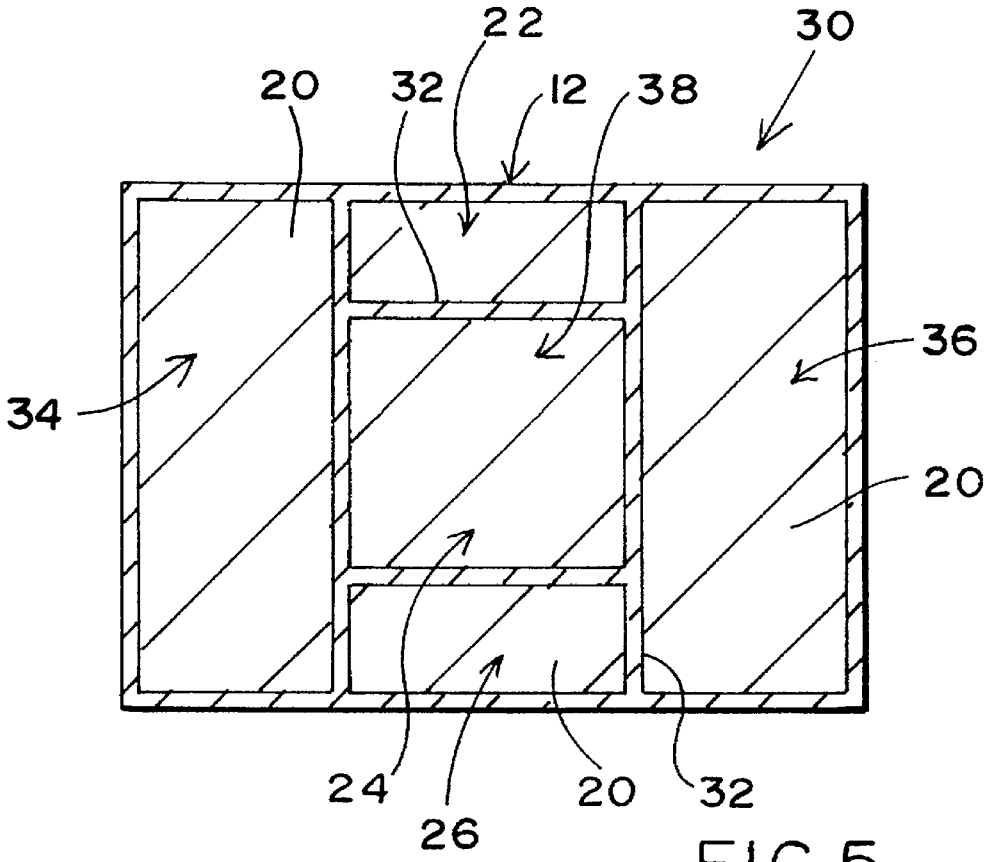
FIG. 5 is a top plan view of an alternative embodiment of the present invention.

An alternative embodiment of the present invention may be seen in FIG. 5. Therein, pillow casing 12 is integrated by divider walls 32. First side head support unit 34, second side head support unit 36 and head back support unit 38 are divided by divider walls 32. First side head support unit 34, second side head support unit 36, and head back support unit 38 are filled with core filling materials 20 heretofore disclosed.

The inside of head back support unit 38 is divided by divider walls 32 so as to form a first neck-bones' support section 22, a head back rest section 24, and a second neck-bones' support section 26. Therefore, in this embodiment of pillow 30, core filling materials can be blown into the first side head support unit 34, second side head support unit 36, first neck-bones' support section 22, head back rest section 24, and second neck-bones' support section 26. This is due to the fact that the inside of pillow casing 12 is divided in advance into the first side head support unit 34, the second side head support unit 36, the first neck-bones' support section 22, the head back rest section 24, and the second neck-bones' support section 26 by divider walls 32, allowing manufacturing efficiency of the pillow 30.

The height of the first neck-bones' support section 22 and the second neck-bones' support section 26 is set to be identical in this invention. However, the height of the first neck-bones' support section 22 and second neck-bones' section 26 can be set differently depending upon the preferences of the user. Furthermore, neck bones T2 is supported by second neck-bones support section 26. If the pillow 10 or 30 is inverted, then neck bones T2 may be supported by the said first neck-bones' support section 22.

It is intended that the description of the preferred embodiments of this invention is illustrative only. Other embodiments of the invention that are within the scope and concept of this invention are herein included with this application.

What is claimed is:

1. A pillow for supine and side-orientated sleeping positions comprising:

a pillow casing having opposed horizontal ends and opposed vertical ends;

a first side head support unit located at one horizontal end of said pillow casing;

a second side head support unit located at the other said horizontal end of said pillow casing;

a head back support unit there between said opposed horizontal ends and having a height lower than said first and second side head support units;

a first neck-bones' support section constructed within the head back support unit located at one of said vertical ends of said pillow casing;

a second neck-bones' support section constructed within the head back support unit located at the opposed vertical end of said first neck-bones' section of said pillow casing, and;

a head back rest section constructed between said first and said second neck-bones' support sections and further having a height lower than the said first and second said neck-bones' support sections.

2. A pillow for supine and side-orientated sleeping positions comprising:

a pillow casing having divider walls with opposed horizontal ends and opposed vertical ends;

a first side head support unit divided by said divider walls and located at one of said horizontal ends;

a second side head support unit divided by said divider walls and located at the horizontal end opposed the said first side head support unit;

a head back support unit divided by said divider walls and located between said first and said second side head support units, and further having a height lower than said first and said second side head support units;

a first neck-bones' support section divided by said divider walls and forming a component of said head back support unit located at one end of said vertical ends;

a second neck-bones' support section divided by said divider walls and forming a component of said head back support unit located at the vertical end opposed said first neck-bones' support section, and;

a head back rest section divided by said divider walls and located between said first and said second neck-bones' support section and further having a height lower than said first and said second neck-bones' support section.

3. A pillow for supine and side-orientated sleeping positions comprising opposed horizontal side head end support units and a central head back support unit there between, said head back support unit further comprising vertically opposed neck-bones' support sections separated by an overall central head back rest section whereby every unit and section is divided into integrated, compartmentalized areas by divider walls.

4. In the pillow of claim 3, said compartmentalized areas comprise five in number.

5. In the pillow of claim 3, said head back support unit has a height which is lower than the height of said horizontal end support units.

6. In the pillow of claim 3, said head back support unit has a height which is lower than the height of said horizontal end support units, and where the head back rest section has a height which is lower than the height of said vertically opposed neck-bones' support sections.

* * * * *